US006318468B1

(12) United States Patent
Zakiewicz

(10) Patent No.: US 6,318,468 B1
(45) Date of Patent: Nov. 20, 2001

(54) RECOVERY AND REFORMING OF CRUDES AT THE HEADS OF MULTIFUNCTIONAL WELLS AND OIL MINING SYSTEM WITH FLUE GAS STIMULATION

(75) Inventor: Bohdan Zakiewicz, Santa Monica, CA (US)

(73) Assignee: Consolidated Seven Rocks Mining, Ltd., Santa Monica, CA (US)

( * ) Notice: Subject to any disclaimer, the term of this patent is extended or adjusted under 35 U.S.C. 154(b) by 0 days.

(21) Appl. No.: 09/465,041

(22) Filed: Dec. 16, 1999

(51) Int. Cl.[7] ..... E21B 43/16; C10G 57/00
(52) U.S. Cl. ..... 166/305.1; 208/95
(58) Field of Search ..... 166/263, 305.1; 208/95, 128, 132

(56) References Cited

U.S. PATENT DOCUMENTS 4,687,491 8/1987 Latty .
4,780,196 * 10/1988 Alagy et al. ..... 208/130
4,930,454 6/1990 Latty et al. .
5,139,650 * 8/1992 Lenglet ..... 208/132
5,725,054 3/1998 Shayegi et al. .

FOREIGN PATENT DOCUMENTS

2231057-A * 11/1990 (GB) .
48.741 4/1992 (VE) .

* cited by examiner

*Primary Examiner*—David Bagnell
*Assistant Examiner*—Jennifer R. Dougherty

(57) ABSTRACT

The present invention is a process for thermal cracking and reforming of a liquid petroleum stream comprising the liquid petroleum fraction, wherein the liquid petroleum fraction is a substantial portion of the first liquid petroleum stream and has a density equal to or less than about 15° API.

18 Claims, 9 Drawing Sheets

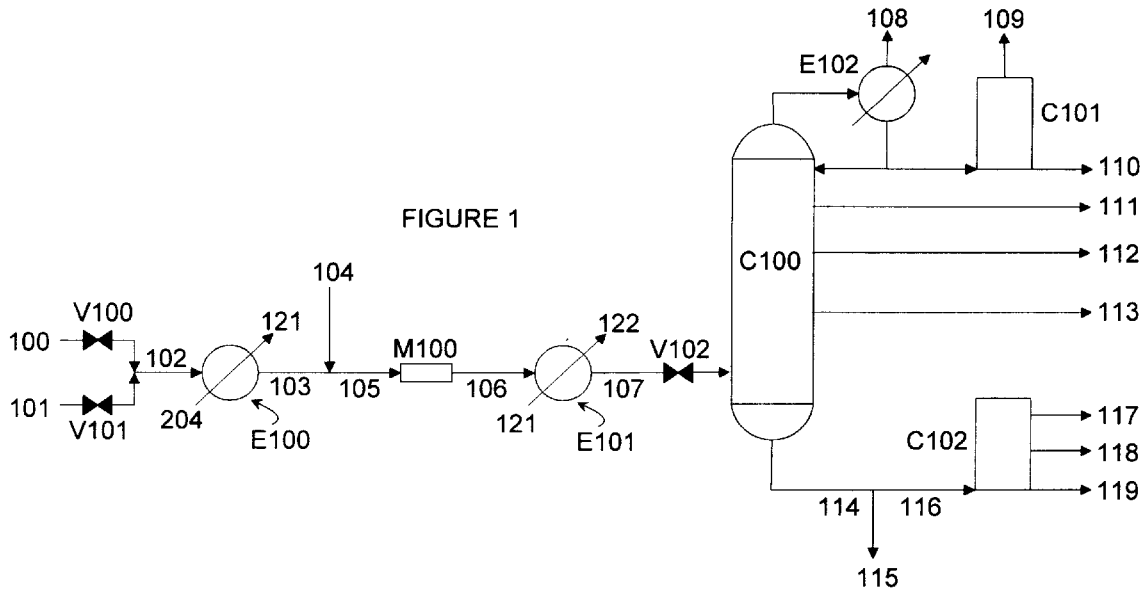
FIGURE 1
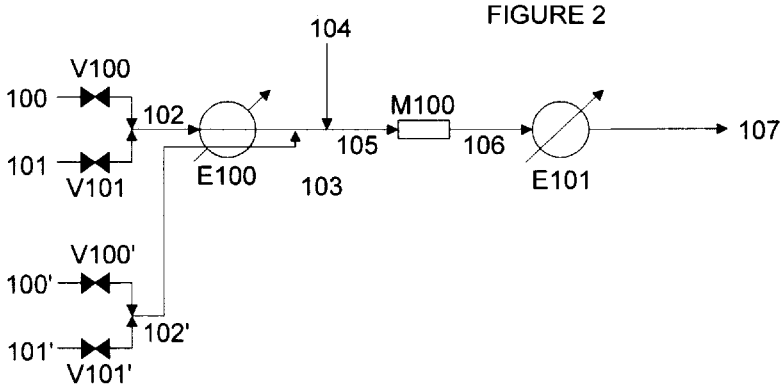
FIGURE 2
FIGURE 3
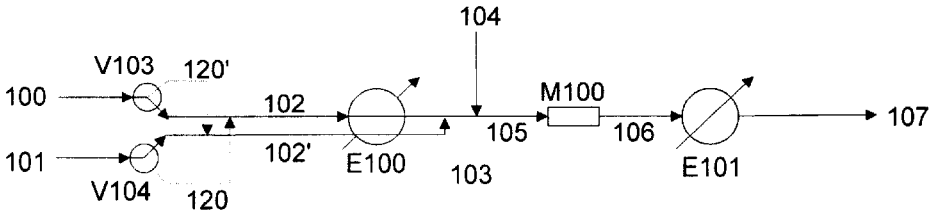

405
102
102'
121
404
400
E100
204
TO 103
TO 103
406

402
403
401

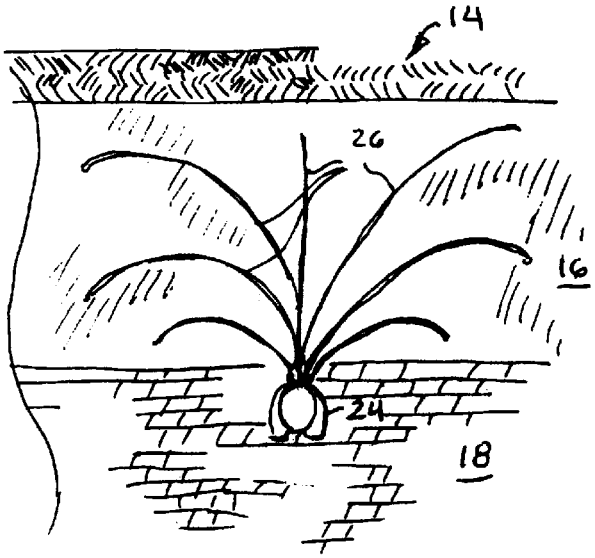
FIGURE 13
FIGURE 14
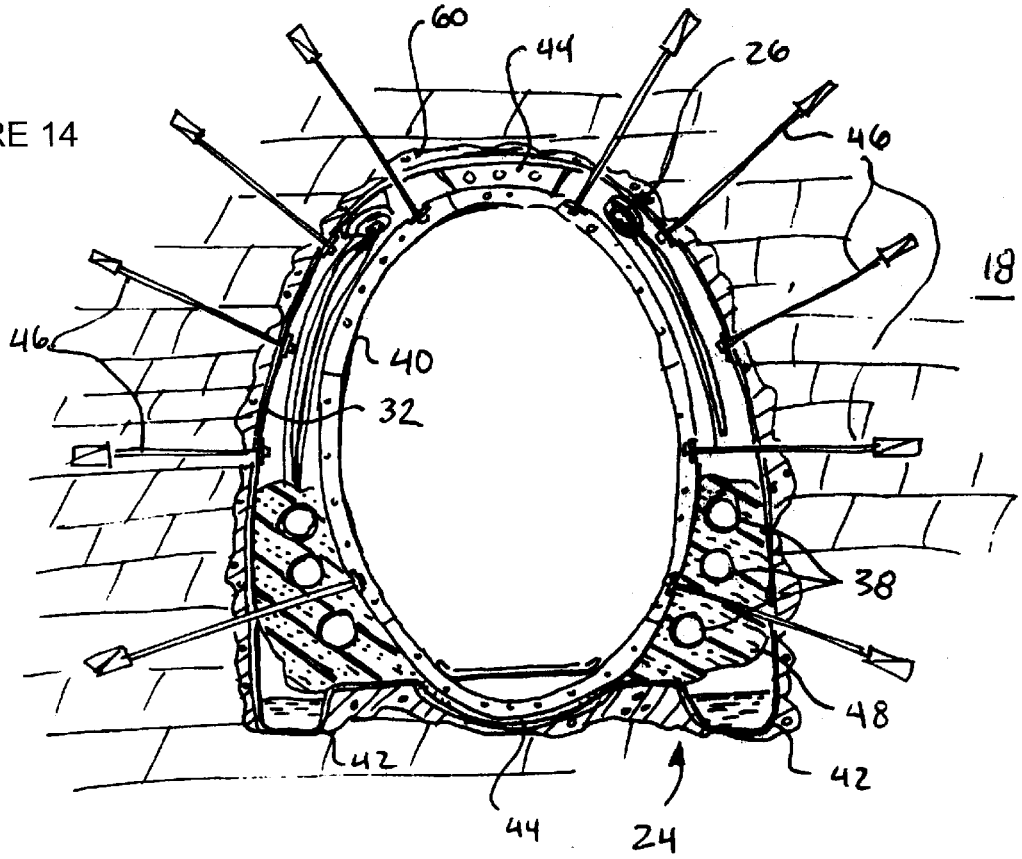

FIGURE 15
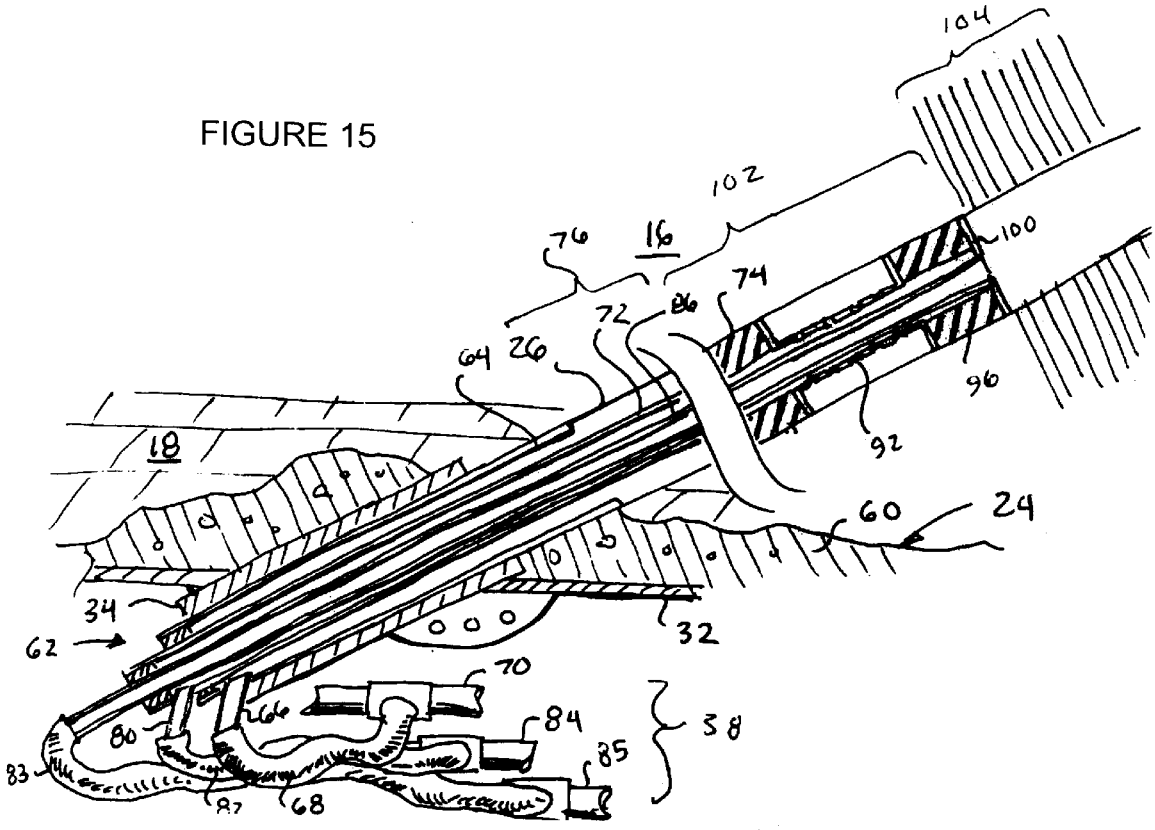
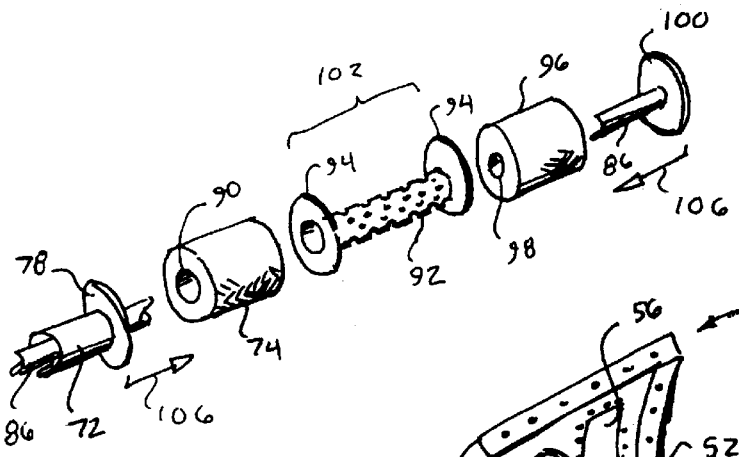
FIGURE 16
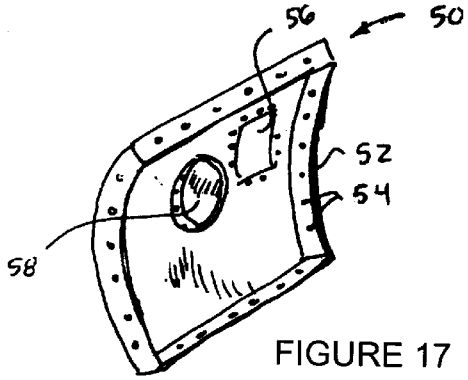
FIGURE 17

RECOVERY AND REFORMING OF CRUDES AT THE HEADS OF MULTIFUNCTIONAL WELLS AND OIL MINING SYSTEM WITH FLUE GAS STIMULATION

BACKGROUND

This invention relates to the recovery and conversion by reforming of petroleum oils front both shallow and deep deposits.

With the traditional method of extraction and recovery of ultra heavy tar, only deposits accessible to open-cast mining could be mined conventionally, the tar being heat-extracted in retorts after having been excavated from the mine pit. None of the existing methods can perform any conversion (reforming) of the oil at the mining site to allow the pumping of an oil product into a transport pipeline. Furthermore, none of the existing methods of thermal or chemical recovery can liquefy and extract any substantial amount of ultra heavy hydrocarbons from the deposit, without violating the economic-basis of the mining operation.

A number of attempts have been made to achieve so called viscosity reduction in order to increase the mobility of the hydrocarbons in the formation, thereby enabling them to be withdrawn by conventional techniques, such as natural flow, pumping, etc. The most popular method has been to reduce the viscosity of the hydrocarbons by elevating the temperature, in consequence of introducing thermal energy by a wide variety of means, such as hot water, in situ combustion, steam, heated natural and combustion gases and chemicals convertible into high pressure hot gases. Some of those techniques have received limited application in the recovery of medium heavy oil, API gravity in a range between 10°–22°, with viscosity not much greater than 200 cp (both at 60° F.) (16° C.) and for a deposit with a medium thickness of 50–100 feet (15–30 metres).

The so-called medium-heavy oils just referred to are, by their nature, mobile to a degree in the deposit, but their velocity of gravitational mobility is very low and can be increased by decreasing their viscosity. Two basic thermal techniques of recovery are known for these medium-heavy-oils.

One technique is usually referred to as "steam-drive", wherein steam is continuously injected into a formation by means of an injection well. The injected steam heats the formation and medium-viscous hydrocarbons and drives the heated hydrocarbons toward one or more adjacent vertical production wells which are employed to withdraw them to the surface. There are the strict conditions limiting this kind of steam driving process, such as:

a) the formation must not be plugged by the gradually cooling products, which means that the natural non-heated oil ought to be light and mobile enough by itself to avoid its solidification when it cools.

b) the permeability of the formation should be high enough to allow penetration of the steam, despite the fact that hydrocarbon material is consolidated in the pores.

c) the pressure of the steam and its temperature should be sufficiently high to allow deep penetration into the formation.

Even when these conditions are fulfilled, only a small portion of the medium-heavy-crude, and rather its light fraction only, can be mobilized and extracted by the steam-drive system, and only from the very upper part of the formation, where the steam has a natural tendency to sweep around the injection well. The lower part of the deposit in general remains unheated and worse, becomes impregnated with the previously heated heavier fractions of the oil from the upper part of the formation that have descended and cooled in the lower part of the formation. As a result, the lower part of the formation is converted into strata that are nonpermeable to any heat carriers, and remains lost as regards further recovery processes.

An alternative to "steam-drive" is "hot water drive" which, in one of the most advanced processes (U.S. Pat. No. 4,305,463) employs a flushing medium injected in a series of pressure pulses to force the heated fluids through the pores by hydraulic ramming. However, despite dramatic improvements in the effect of "driving" the hydrocarbons through the formation pores, the method still has application to light and medium heavy oil!s only, and cannot be used for ultra heavy tars and asphalts.

In the second basic technique, commonly referred to as single well injection or "huff and puff", steam, heated gases, combustion gases, or a combination of them is injected into the formation through a single injection well in a batch quantity for a selected period (huff phase). The formation is allowed to "soak", during which time the heat permeates, heating a larger volume of the hydrocarbon reservoir, and the heated mobile hydrocarbons are supposed then to be withdrawable from the formation through the same well during an extraction period (puff phase).

The "huff and puff" technique has arisen due to the known inefficiency of the steam and hot water driving methods, in an attempt to deal with heavier oils and thicker deposits. However, this process basically contradicts the logic of the use of driving forces in the formation, as commonly applied in the production of liquids from boreholes; it delivers small quantities of melted, heated product, and only in the case of a formation thick enough to allow some product to flow into the injection well from the inverted cone region of the formation that is heated by the injection and soak. The major portion of the heated, melted hydrocarbon is repelled in the "huff phase" into peripheral parts of the well region where it impregnates, solidifies in and plugs the pores of the formation.

There are processes which include so-called "enhanced recovery" techniques employing different chemicals and agents, all of them aiming to achieve better mobility of the oil by gravitational and/or pressure forced flow of liquids. The majority of these techniques are orientated towards decreasing surface tension between oil and water phases, and/or decreasing the oil viscosity in the formation. Some of these known techniques have limited use in the recovery of medium-heavy-crude under certain conditions. However, despite all these efforts the majority of the oil-bearing formations all around the world are known to contain enormous reserves of heavy and ultra-heavy hydrocarbons from which the crude cannot technically and economically be recovered in large quantities by the employment of any known process. None of the known processes is able to provide any improvement in the mobility of ultra-heavy crude or any reforming and conversion of ultra-heavy crude into a lighter product i.e. of pipeline quality—at the well site.

A useful steam generating system is described in U.S. Pat. No. 4,930,454. In that patent is described a method for catalytic combustion of heavy topped Kern fuel oil (13° API) as a fuel for steam generation. It was the claimed and experimental intent of the inventors of that patent to provide stoichiometric oxygen for the fuel as the admixture passed over the catalysts for catalytic combustion. The catalyst temperature was carefully controlled within the operating stability range by the addition of liquid water upstream of the catalyst.

Although other diluents are mentioned as useful in admixture described in that patent, the specific example directed to such a heavy fuel oil indicated that water was added to the oil on a 14:1 by weight ratio to obtain a 99.7% carbon conversion to CO2 ("complete combustion" claimed and described therein). It appears that using any of the other diluents, all of which were gas, could not possibly meet the requirements of the invention, i.e., the extreme dilution of the reactants by performing catalyst temperature control using sensible heating of gas would prevent reaction within an economically volume of catalyst. The skilled person would decide not to endeavor to experiment with such easily predictable failure.

It is an object of the present invention to recover ultra-heavy and heavy hydrocarbons and tars, particularly crudes having API gravity below 15° (at 60° F.), from consolidated or non-consolidated formations having low to very high relative permeability to oil, gas and water.

SUMMARY OF THE INVENTION

According to the present invention, there is provided a process for the recovery of heavy and ultra-heavy hydrocarbons from formations containing petroleum deposits, comprising: injecting into the formation either concurrently or cyclically:

a) hot flue gases obtained from the combustion of fuel at high temperature and pressure; and b) a hydrogen donor solvent liquid; and raising the hydrocarbons thereby mobilized and liquefied by gas lift.

Preferably, the recovery is performed in a "daisy" well having a main central bore and a plurality of slant bores with their lower terminations lying in an array surrounding the central bore. Preferably also, the flue gases are injected at high pressure down the slant bores, the solvent is injected at a lower pressure down the main central bore, and the gas lift is generated in a casing of the main central bore. The flue gases may be obtained from the furnace of a thermochemical reforming plant employed to reform the recovered hydrocarbons into a lighter product adjacent the well head. The solvent may be a highly hydrogenated naphthenic solvent obtained as a fraction from the product output of the thermochemical reforming plant.

The invention further provides a well for the recovery of heavy and ultra-heavy hydrocarbons from formations containing petroleum deposits, comprising a main central bore and a plurality of slant bores terminating at their lower ends in an array around the central bore, the main central bore containing at least a passage for delivering solvent downward for injection into the formation and a passage in which extracted hydrocarbons are raised by gas lift, and the slant bores each containing at least a passage delivering hot flue gases downward for injection into the formation.

In the preferred form, the main bore is formed at an intermediate level with a chamber having a platform across it, the slant bores commence at and extend downward from the platform, and above the intermediate chamber the main bore includes also a passage delivering hot flue gases downward to the slant bores.

The well may be operated in conjunction with a thermochemical reforming plant adjacent the well head which reforms the recovered hydrocarbons to produce a pipe-line quality product, said plant including a furnace supplying the hot flue gases for the well, and means for fractionating the plant output to obtain the solvent. U.S. Pat. No. 4,852,666 is incorporated herein for its description of a method and apparatus for causing deflection of a drill bit to form a shaft at the distal end of a primary shaft or at intermediate points thereof substantially acutely angled away from the longitudinal axis of the primary shaft. A "daisy" well system may thereby be formed from a central vertical shaft and having therefrom at least a plurality of substantially acutely angled and/or horizontally deflected shafts which may individually inject hot gas and/or solvent into the formation and recover crude oil to the individual conduits positioned within those acutely angled and horizontal shafts.

The horizontally arranged shafts are preferably used in a gas barriering embodiment to suffuse the formation at above an impermeable layer forming a floor in the lower regions of the oil bearing strata with at least hot gas, causing the hot gas to rise through the less dense strata to a substantially impermeable cap of the oil bearing strata. Such action lifts and mobilizes the heavy crude oil and then forms a gas cap barrier over oil bearing strata. It is preferred to maintain separate barriering wells from production wells such that the pressure maintained at the barriering wells is substantially higher than at the production wells. The method of maintaining such pressure differential creates an ever increasing volume of a high gas pressure region in the entire area of the oil bearing strata, such that as crude oil is removed from one area, crude oil from another area is prevented from moving into the high gas pressure area and effectively maintaining pool localization that was originally established at the beginning of the enhanced oil recovery process. Thus, the hydraulic head of the crude oil remaining in the formation is locally retained and the solvent-enhanced pressurized drainage of heavy crude to the lower strata daisy well conduits is further enhanced.

The present invention also comprises an extensively tested method for reforming heavy crude. The invention reforming process is heated primarily by convective heat transfer. Flue gas of an open flame or catalytic combustion has its first substantial heat transfer to heat transfer surface for generation of steam, steam superheating, or other appropriate high temperature heat sink. It has not been known to perform non-catalytic thermal cracking or reforming without the intense heat transfer arising from direct exposure to radiant heat transfer from an open flame or other high radiant heat transfer source. The present thermal reforming (or thermal cracking, as the precise mechanism is not certainly known at the present) takes place by heat transfer solely from a flue gas of the combustion process at less than about 2000° F.

In the invention reforming process, a heavy crude is fed to the tubes of a first heat exchanger. The first heat exchanger may comprise a tube and shell heat exchanger, a fired heater convection section, or other such heat transfer devices as may achieve the objects of the invention. At the end of a first period, the flow of crude is stopped and a steam only stream is fed to the tubes for a second period equal to the first period. The flow of crude is then resumed for a first period again. This cyclic operation under the conditions described below result in a surprising degree of cracking, reforming and/or hydrogenation of the heavy crude. It is preferred that the velocity of the crude and steam in the tubes be very high, approaching or reaching sonic velocity for the separate conditions of the separate flows. It is believed that the crude flow period deposits on the tube walls a very thin layer of coke as a result of partial thermal cracking of the crude. The flooding of the steam only stream places in contact a superheated water vapor with a high carbon liquid and/or coke, the result of which is the water gas reaction wherein are formed hydrogen radicals and hydrogenated carbon molecules. The high carbon liquids and/or coke become hydrogenated thereby and are swept clean from the inside tube surface.

The effluent of the reforming/cracking heating is mixed with a second flow of heavy crude. The presence of hydrogenating species in the effluent causes the second flow of heavy crude to decrease in specific gravity as lighter molecular components are formed on contact. The effluent/heavy crude mixture is heated in flue gas from the reforming/cracking heating step. This heated mixture is then separated in conventional fractionation to preferably remove a portion of that mixture with a boiling range greater than 750° F., or mixtures of the boiling ranges therein, forming a solvent.

The flue gas after heating the above mixture is preferably at a sufficiently high pressure so that it may be injected into a formation with or without the solvent portion.

The present invention provides a novel method of stimulated oil production employing essentially soot-less combustion gas in combination with heated solvents formed from the extracted oil itself. Aggressive coverage of the formation is provided by an oil mining technique in which many curved wells may be drilled upward into the formation. Each well may have a multi-channel stinger which may be used to simultaneously introduce heated combustion gas and solvent into different locations within the formation extracting oil from yet a different location. The locations of the introduction of the solvent and/or the hot flue gas among the different wells and among different locations within individual wells may be varied. A multiple walled tunnel construction segregates potentially hazardous materials from working personnel and provides a tunnel suitable for the above techniques.

Specifically then, the present invention provides a method of oil production from an underground oil formation including the steps of extracting oil from the formation and then catalytically combusting a fuel portion of the oil to produce substantially soot-less combustion gases. These combustion gases are combined with a solvent portion of the oil and the combustion gases and solvent portion of the oil are injected into the formation to promote additional extraction. A principal part of the combustion gases may be $CO_2$.

It is therefore one object of the invention to provide an inexpensive source of stimulating material for enhanced oil recovery. The combustion gases may be produced directly from oil on site without the need for costly transportation.

It is another object of the invention to provide a more effective enhanced oil recovery technique. Mixing the hot combustion gases with solvents extracted from the oil of the formation provides the benefits of a thermal and miscible enhanced oil recovery technique.

The combustion gas heated solvent may include mixtures of hydrocarbons over a range of molecular weights selected to extract heavier components of the oil from the formation.

It is yet another object of the invention, therefore, to provide a broad spectrum solvent capable of removing a greater portion of the oil in the formation without asphaltization of the formation.

The soot-less combustion gasses may be produced without a significant steam or water component.

Thus, it is yet another object of the invention to provide an enhanced oil recovery technique suitable for clay formations in which the introduction of water may decrease the formation's permeability.

The combustion gases are preferably produced catalytically and the catalytic combustion gas temperature moderated preferably using re-cycled and cooled combustion gases as a temperature moderator of the combustion gases. The non-condensable gases injected to recover the underground crudes are separated from the condensable portion of the mixture rising to the surface and minimize re-compression utilities as compared to atmospheric air, as the separated non-condensable gases emerge from the surface level conduits of the crude oil recovery system at substantially higher than atmospheric pressure. Since the temperature has been substantially reduced over the temperature it had at injection into the formations, the actual compressed volume and compression utilities of the recovered combustion gases are substantially and surprisingly reduced over using atmospheric pressure gases.

The method may make use of an equipment access tunnel extending horizontally along a tunnel axis under the oil formation. The tunnel may be sized to receive drilling equipment and personnel. At a number of locations along the roof of the tunnel, a series of wells may be drilled upward from the tunnel roof into the formation, where the wells follow a curved path approaching a horizontal plane and where the location of the wells is selected to disperse the path of the wells through the formation. Oil may be collected when it flows downward into the tunnel from a group of the wells.

Thus, it is another object of the invention to provide a novel technique for oil mining suitable for use with the enhanced oil recovery technique described above. The curved nature of the wells allows them to follow a given strata of the formation in cases where the formation has many oil permeable stratum separated by impermeable layers.

The method may employ a multi-channeled well casing inserted into a well, the channels of the well casing opening to the surrounding formation at different portions along the length of the well. Pressurized, heated solvents and pressurized hot gases may be introduced into different channels of the casing to provide solvent injection and barriering, respectively, while oil is extracted from a different channel or from proximate but different wells.

Thus it is another object of the invention to provide an extremely versatile method of solvent injection where solvent may be passed through a substantial portion of even a low permeability formation by rotating the site of solvent injection among points in an individual well and among different wells.

When the wells are drilled upward from the access tunnel, they may be interconnected by means of a manifold. The tunnel may then be lined with first sealed metal panels so that the manifold is contained between the first metal panels and the tunnel walls. A second set of sealed metal panels may be anchored to the tunnel walls and positioned coaxially outside the first sealed metal panels and the space between the second sealed metal panels may be filled with a gas impervious grouting. An air stream, separate from the air within the first set of sealed panels, may flush the space between the first and second sealed metal panels.

Thus it is another object of the invention to provide a robust tunnel system suitable for use in drilling upward wells into a formation and that may contain and dilute hazardous gasses and liquids that might otherwise enter the tunnel and that may further reduce the risk of combustion or other hazards from the extracted hydrocarbons.

The first sealed metal plates have a cross-section different than the cross-section formed by the tunnel of the second sealed metal plates and the first and second sealed metal plates are braced with respect to each other.

Thus it is another object of the invention to provide an extremely rigid tunnel system in which different cross-sections of the tunnels form an implicit bracing.

Drilling guides may be pre-affixed to the second sealed metal panels.

Thus it is another object of the invention to simplify the drilling of a complex set of upward curved wells as proposed by the present invention.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

U.S. Pat. No. 4,852,666 is incorporated herein for its description of a method and apparatus for causing deflection of a drill bit to form a shaft at the distal end of a primary shaft or at intermediate points thereof substantially acutely angled away from the longitudinal axis of the primary shaft.

BRIEF DESCRIPTION OF THE DRAWINGS

FIG. 1 is a flow diagram of the invention process showing the steps of reforming and product separation.

FIGS. 2 and 3 are flow diagrams of the invention process showing alternate reforming embodiments.

FIG. 13 is a cross-sectional elevational view of the access tunnel in FIG. 11 in a plane perpendicular to the axis of the tunnel showing the divergence of the upwardly curved wells with respect to the cross-sectional plane of FIG. 12;

FIG. 14 is a detailed view of the tunnel of FIG. 13 showing its component coaxial meatl shells and the positioning of oil collection and solvent delivery manifold between the shells;

FIG. 15 is a cross-sectional view in elevation along one of the wells of FIG. 12 showing three channels connected to a separate manifold contained between the tunnel walls shown in FIG. 14 and further showing a packer positioned in the well and partitioning the well into separate zones along the well length each serviced by a different channel;

FIG. 16 is an exploded perspective view of the packer of FIG. 15;

FIG. 17 is perspective view of one metal panel from which the shells of FIG. 4 may be constructed showing an access panel and window incorporated into the shell;

DETAILED DESCRIPTION OF THE INVENTION

Figure 4:
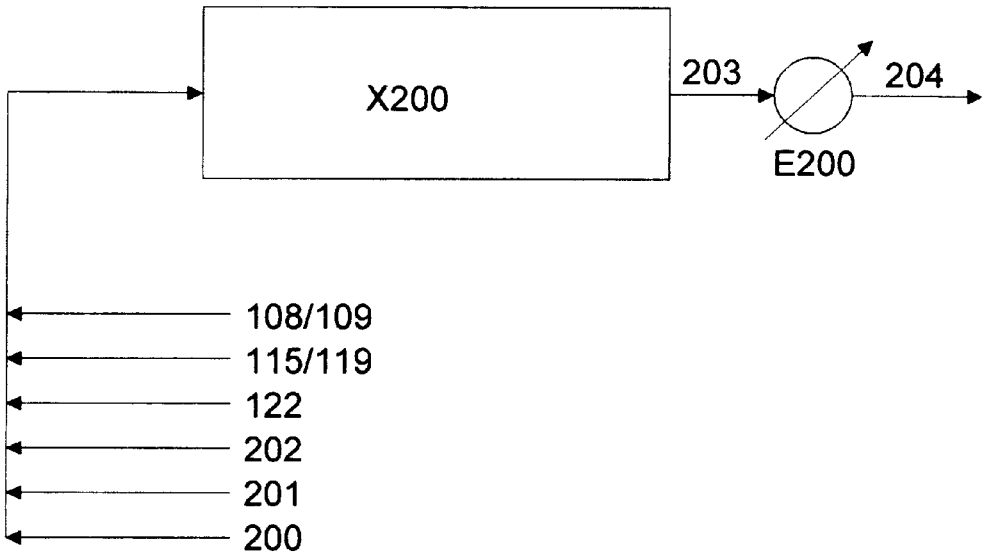
FIG. 4 is a diagram of the open flame or catalytic combustor of the invention including a steam generator or superheater.

The present invention is now discussed with reference to FIGS. 1–6. Duplicated item numbers that appear in those figures identify substantially the same aspects of the invention process. The present invention is also discussed with reference to Tables 1–9 below. Tables 1–9 are a summary of series of experiments averaging data for thermal cracking/reforming a heavy crude from San Ardo deposit in California. The data of Tables 1–9 are scaled upward ten times from the actual results of data from a pilot plant with capacity of 10 barrels per day to a process plant with 500 barrel per day of crude oil feed.

It is well known in the art to use thermal cracking of heavy crudes to obtain lighter components and coke and/or asphaltenes. Thermal cracking not widely practiced except for the several coking processes. However, due to substantial problems with resid fouling and metal deactivation of catalysts, catalytic processes for heavy crude cracking or reforming are generally unavailable for commercial use.

The present invention eliminates substantial coke production in a final thermally cracked and/or reformed product while unexpectedly obtaining dramatic increase in lower molecular weight components. The unexpected benefit of low or no coke production is achieved with substantially entirely convective heat transfer for the thermal cracking/reforming reaction.

In FIG. 1, a heavy crude, as in Table 1, is separated to form a resid portion and is fed as stream 100 through valve V100 to heat exchanger E100 in pipe section 102. Exchanger E100 may take many forms to accomplish the invention objects, although a well tested design comprises a tube and shell heat exchanger, whereby the stream 100 is divided into several tubes while a high temperature heating gas, is flowed over them in the exchanger shell generally countercurrent to the flow in the tubes. Streams 204 and 121 are in a specific embodiment of the invention flue gas from a combustor X200 and are respectively inlet and outlet streams from exchanger E100. Flue gas 204 temperature is preferably less than about 2000° F.

Exchanger E100 tubes of the specific examples of Tables 1–9 comprise about 30 feet in length with 1 inch ID and minimal thickness. In that specific example, the tubes along their longitudinal length comprise extended surface in the form of V-shaped fins having about 30 degree V-shape and about 1.5 inches in lateral cross section width. Each tube had four such extended surface fins spaced equally about the outside surface of the tube. Studs, short or angled fin sections and other such known extended surface for tubes may be used to achieve the desired improvement in convective heat transfer to from 1.5 to 3.0 times that without the extended surface on the tubes, and more preferably about 2.0 times the convective heat transfer rate without the extended surface. The flow of the fluegas was directed substantially parallel to the fins of exchanger E100. Within substantially the entire length of each of the tubes were helically twisted metal rods of about 0.2 inches thickness having approximately 3–5 inch helices, whereby liquid flows within the tube are subject to turbulent flow against the inside tube walls. In addition, alternating flows of crude 100 and steam stream 101 were flowed through the tubes at or substantially sonic velocity for the range of conditions taking place during the reaction operation therein. The combination of the finned tubes, internal flow helices and high liquid flow velocity provide extremely high heat transfer rates required for thermal cracking/reforming of heavy crude. Such heat transfer rates are determinable by the skilled person with the disclosure herein and with reference to thermodynamic data for the cracking and reforming reactions described herein. Although tube diameters of 0.3 to 2.0 and higher inches may be found effective for practice of the present invention, a most preferred range of tube diameters is from 0.5–0.75 inches. A pilot plant flow rate of 4 BPH at about 2 bars average reactor pressure was divided among about 6 tubes as described above.

As just described, stream 101 is a steam stream. Stream 101 consists of steam at about 1200–1400° F. The steam flow rate for the pilot plant must be sufficient under the above specific conditions to provide for a velocity close to sonic. This high sweep rate is critical to the operation of the invention. Crude stream 100 is fed to exchanger E100 at a temperature of about 800° F., the reaction therein inducing an moderate to extensive thermal cracking of the crude resulting in deposition of a thin layer of coke on the heat transfer surfaces. The crude flow 100 is stopped and steam 101 is solely fed to the tubes of exchanger E100. The coke and residual liquids are stripped from the tube and helix surfaces by steam 101, the resulting turbulent flow heat transfer and high sensible temperature of the steam causing an extensive water gas reaction reducing most of the coke to hydrocarbon liquids, causing hydrogenation of the residual liquids and formation of hydrogen radicals available for further hydrogenation of long chain hydrocarbons. The outlet temperature of the crude 100 from exchanger E100 is preferably no greater than about 1000° F.

Stream 104 comprises heavy crude relatively free of water at wellhead temperatures of about 300–350° F. Stream 104 flows continuously to mix into the discontinuous crude 100/steam 101 flows from exchanger 100, stream 103. The available hydrogen radicals from the steam 100 flow through exchanger E100 are absorbed into stream 104, the combined streams thereafter forming stream 105 which is mixed in a static mixer M100 to form stream 106. Stream 106 has a temperature of about 400° F. which is then heated in exchanger E101. Exchanger E101 is heats stream 106 countercurrent to the fluegas stream 121 so that fluegas stream 122 exits exchanger 106 at about 450° F. The heated stream 107 comprises a reformed crude with substantially increased specific gravity and shifted product slate.

Tables 1–9 illustrate the conversion results of the invention reforming process. Table 1 shows the properties of the San Ardo crude resid processed in the above specific example. Table 2 shows the typical product slate of naphtha, kerosene, light gas oil, gas oil and resid that would be produced from that crude under standard separation in a prior art crude unit. Table 3 shows a combined product flow of "solvent" fraction that may be used for injection with the fluegas 122 into a formation for enhanced crude recovery. As shown in Table 4, the reformed resid produces an additional 160 BPD total gas oil with the invention process.

Tables 5 and 6 show the results of maintaining the resid cracking temperature within exchanger E100 at about 5400° C. The product slate of Table 6 is the result of resid cracking and reformation from three passes through the invention reforming. It is clear that an original 340 barrels of resid at 8.1° API have been reduced to 9.1 barrels of resid at 6.5° API. The product slate is distributed from the resid such that about half of the liquid volume production is within the immediately usable product range of diesel to gasoline naphthas.

Tables 7 and 8 show similar results for maintaining the resid cracking temperature within exchanger E100 at about 482° C. In this case, resid equals about 45 barrels at 5.5° API. Table 9 consists of Tables A–C, showing, respectively, produced gas composition, "solvent" (naphthas and kerosene) composition in simulated gas chromatograph carbon distribution, and flue gas 121 composition.

Referring again to FIG. 1, columuns C100, C101 and C102 are respectively typical separation processes performed in the atmospheric column, stabilizer and vacuum columns. The product streams 110 to 113 and 117 to 119 are LN, HN, KERO, DIESEL, LVGO, HVGO and resid. Any of these are optionally available for use as solvent, although it is preferred that only the light and heavy naphthas and kerosene be combined for that aspect of the invention. Streams 107 and 114 are the reformed crude in unseparated and topped streams. Produced gas streams 108 and 109 comprise mainly butane and lighter components. As shown in Table 9, the high hydrogen content of the produced gas is evidence of the hydrogen production according to the reactor reaction. Although resid 119 is a preferred feed to stream 100, streams 107 and/or 104 or their combination will be effectively reacted in the cracking/reforming reaction of the present invention.

FIGS. 2 and 3 show a method for using a single heat exchanger shell for two separate tube bundles for the invention reaction. In FIG. 2, streams 100 and 101 are fed to stream 102 and therethrough in a tube bundle to exchanger E100. Streams 100' (another resid or crude stream) and stream 101 (another steam stream) are fed to stream 102 and therethrough in a tube bundle to exchanger E100.

In FIG. 3, streams 100 and 101 are arranged upstream of ganged valves V103 and V104 so that when crude 100 is flowing to inlet pipe 102 for a first tube bundle, steam 101 is flowing to inlet pipe 102' for a second tube bundle within exchanger E100. At the end of the desired flow period, the flows automatically switch along broken lines 120 and 120' so that respectively steam 101 flows to pipe 102 and crude 100 flows to pipe 102'. This method eliminates a full shutoff of flow for streams 100 or 101 during the pulsed operation of the invention.

It has been found that the invention cracking/reforming process is effective at a flow period of streams 100 or 101 of about equal to or less than 15 seconds. More time under the conditions of the above specific example increases coke formation, while less time reduces favored thermal cracking. However, the objects of the invention may be in part achieved with flow periods of from 5 to 30 seconds.

FIG. 4 is a generalized diagram of a combustor X200 of the present invention. One of the preferred embodiments of the invention for combustor X200 is as a catalytic combustor as in U.S. Pat. No. 4,687,491 so that high pressure fluegas 122 may be produced at the atmospheric to 800 psia range, although an alternate embodiment may use an open flame at atmospheric conditions or up to and above 250 psia as permitted by operation of combustion equipment. Production of high pressure flue gas is an object of the invention whereby oil recovery flue gas may be formed with the invention cracking/reforming process. Fuels include stream 108/109 from produced gas, resid streams 115/119 and other fuels stream 202. Oxidant stream 201 comprises air or enriched air. Diluent streams 200 and diluent stream 122 comprise non-liquid water streams for reducing temperature in the combustor X200. As a preferred embodiment, combustor X200 as a catalytic combustor is operated with substoichiometric volumes of oxidant compared to fuel. The production of CO in the fluegas is preferred and the outlet temperature of fluegas stream 203 is maintained at about 2200–2400° F. thereby. In the above specific example, the combustor X200 uses resid as fuel stream 115/119 with air as the oxidant stream 201 such that the thermal output is about 150MMBtu/hr. A portion of fluegas 122 is recycled as a diluent gas for temperature control.

In FIG. 4, a critical temperature control step is made for stream 203. High temperature heat sink exchanger E200 cools stream 203 so that it is generally no higher than 2000° F. The cooling medium is preferably steam superheated for use as stream 101 or 101'. This isolation of the process of exchanger 100 from the radiant heat transfer of combustor X200 and first heat transfer to the high temperature heat sink is a significant departure from the prior art methods.

Figure 5:
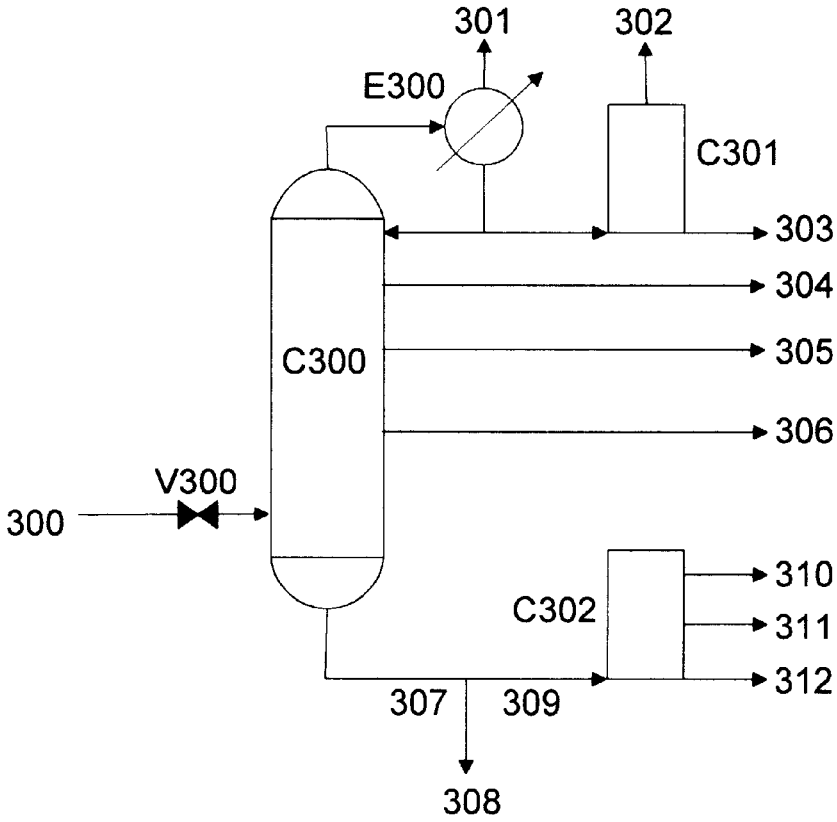
FIG. 5 is a diagram of a product separation process for wellhead oil separating from it solvent or other products as desired prior to reforming.

FIG. 5 shows separation of wellhead crude 300 in a manner similar to that shown in FIG. 1 such that a resid 312, topped crude 307 or crude 300 may be used in the cracking/reforming process of the invention. As in FIG. 1, typical products are produced gas 301 and 302 from atmospheric column C300 and stabilizer C301, light naphtha 303, heavy naphtha 304, kerosene 305, diesel 306, topped crude 307/308/309, light gas oil 310, heavy gas oil 311 and resid 312.

Figures 6, 7, 8:
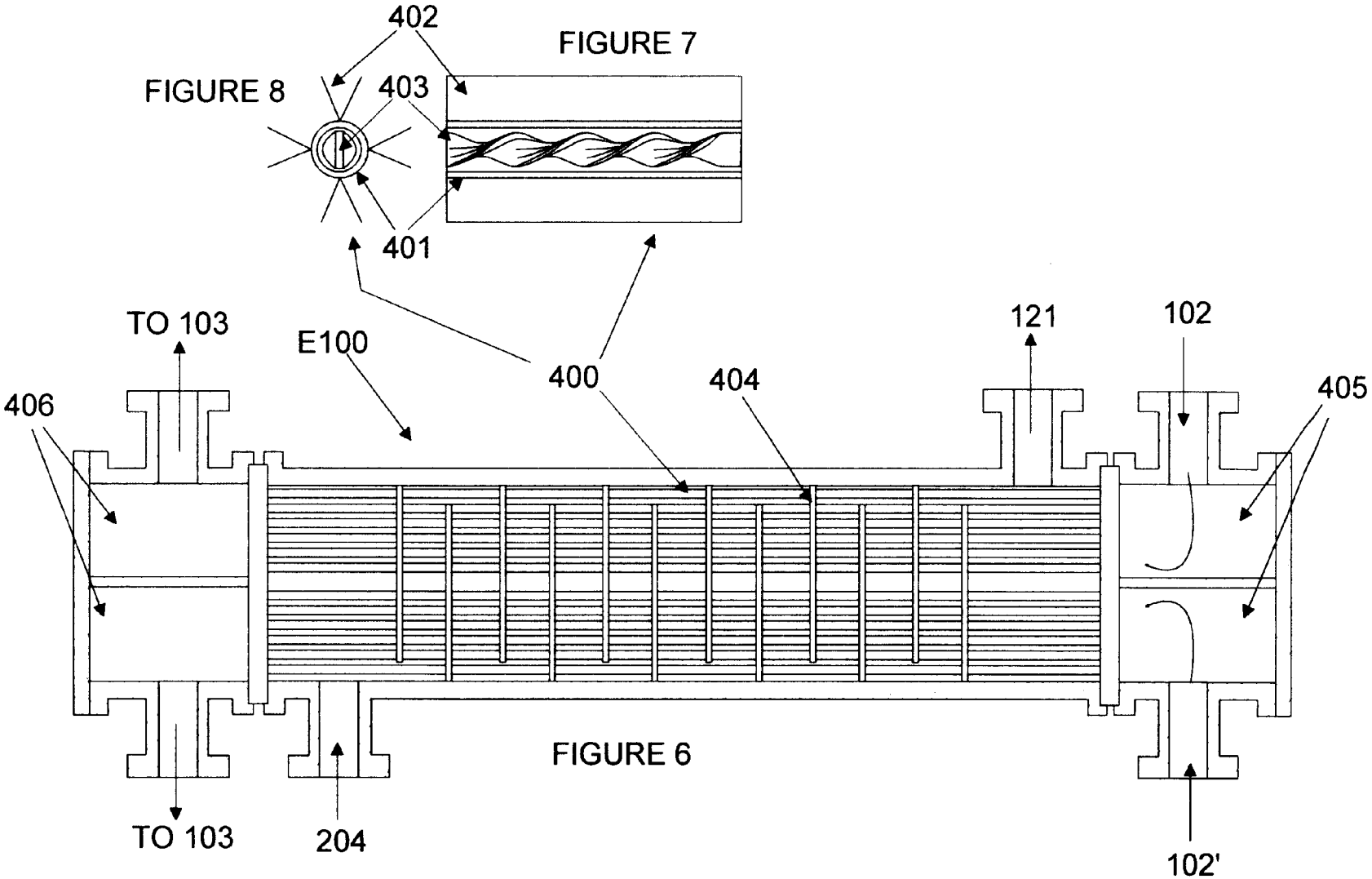
FIG. 6 shows a cutaway side view of an embodiment of a reforming reactor heat exchanger.
FIGS. 7 and 8 are respectively longitudinal and lateral cross sections of one of the tubes of the exchanger of FIG. 6.

FIG. 6 is a side view of a shell and tube exchanger embodiment of exchanger E100 for the processes of FIGS. 2 and 3. Pipes 102 and 102' are fed to separate chambers 405 and therefrom to separate tube bundles of tubes 400 connecting to separate chambers 406. From chambers 406, the process flows are combined to form stream 103. Fluegas 204 enters the shell side of exchanger E100 and exits as stream 121. FIG. 7 shows a cutaway side view of a tube 400 showing helical flow device 403 wherearound process flows are vigorously directed against the inside walls of tube walls 401. FIG. 8 is a cross section of the full tube 400 of FIG. 7, wherein is shown the V-shaped extended surface longitudinal fins 402 equally located about the outside surface of tube walls 401.

As described above, FIG. 9 shows a range of operations available from operation of the invention process whereby, separately or in variable mixtures, "solvent" streams 110–113, 117, 118, 303–306, 310 and/or 312 may be forced in to oil bearing formations either as a liquid stream alone or after mixing with the fluegas 122. The injection of these streams into the formation results in solvent assisted heating and hydrogenation of the underground heavy crudes, bringing wellhead crude 300 to the surface.

It will be appreciated that crude 300 will contain, after operation of the invention injection, a substantial volume of the "solvent" streams recovered with the formation heavy crude. It will be preferable to recover all or a part of the "solvent" from the formation crude in stream 300 before the reforming process of FIGS. 1–3. The operation of the separations of FIG. 5, or for that case FIG. 1, are not intended to be completed for all the products shown in all cases. It is known to construct only sufficient separation equipment or facilities to accomplish only a portion of the separations shown. As an example, only the naphthas and kerosene may be separated in FIGS. 1 and/or 5 might be separated as a first desired "solvent" stream for injection into the formation of FIG. 9.

The heavier components might be retained in a form of topped crude for pumping or storage and later processing. The locations of oil fields are typically remote from the complete refining and final processing location, such that a desired "solvent" fraction is constantly being recovered (as streams 303–305) and produced (as streams 110–112) from the crude 300 from a formation.

Recovered "solvent" (or "solvent" from other crude processing from storage) volume may be sufficient such that required injection rate can be satisfied entirely from it. In that case, no separation of the stream 107 is required prior to pumping the stream to a remote refining or processing location.

Figure 9:
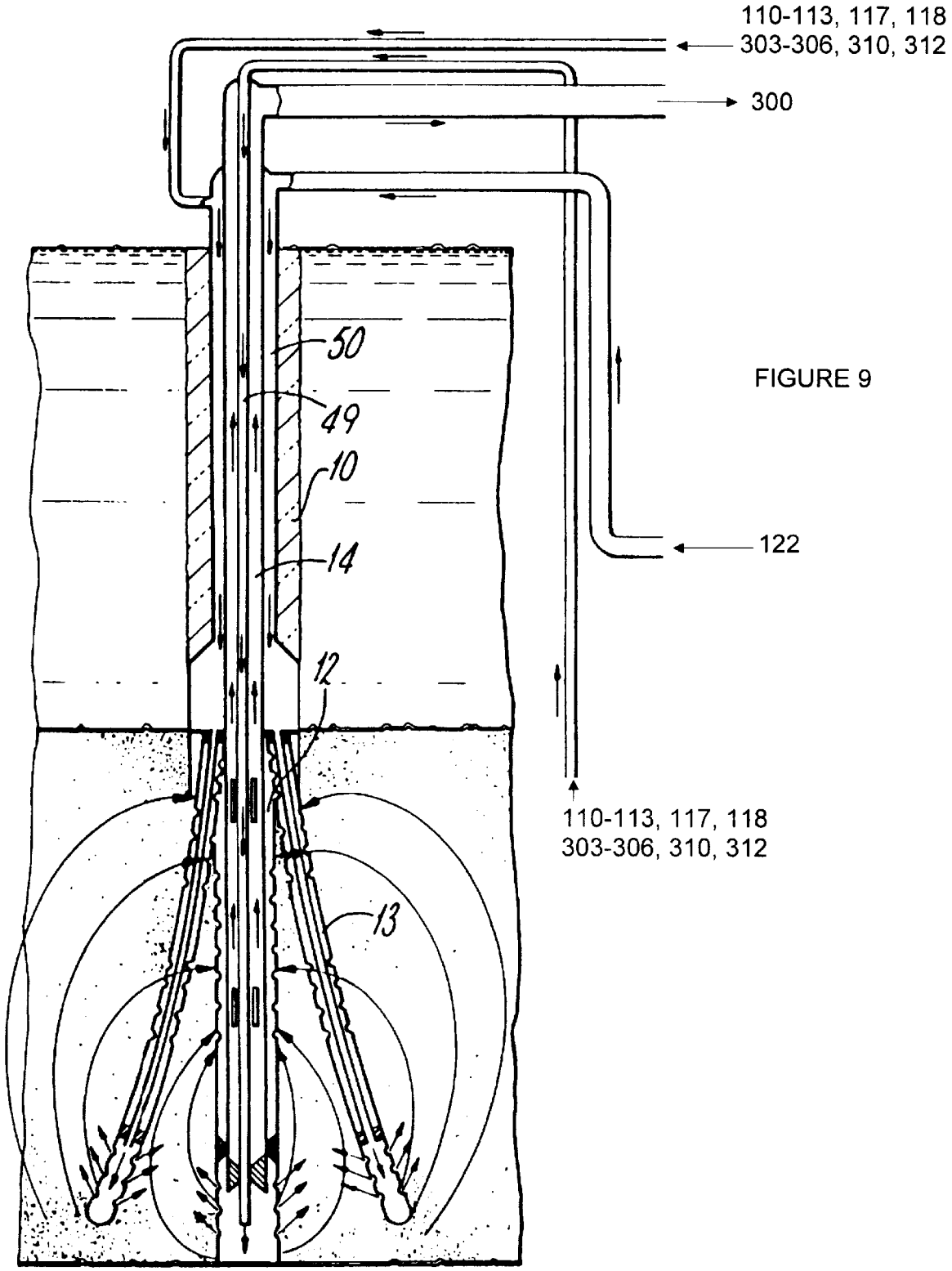
FIG. 9 shows the present oil recovery portion of the present invention, whereby fluegas and "solvent" are injected into a formation via a 'daisy' well for oil recovery.

With further reference to FIG. 9, crude 300 plant is obtained from a 'daisy' well 10 with a central solvent injection and production bore 12 surrounded by six slanting gas injection bores 13. In the case of a thick deposit, one such 'daisy' well can recover as much as 80% of the total accumulation of hydrocarbons over an area of approximately 1 to 1.2 acres (0.4 to 0.49 ha), although the recovery may increase depending on crude and formation qualities.

The crude 300 from the annular casing 14 of the production bore 12, which will typically be an emulsion of crude, solvent, water and gas, enters a main separator at elevated temperature and pressure, for example, 450° F. (232° C.) and 460 PSIG (3151×10, N/M2).

The main separator, as well known in the prior art, has internal vertical apertured baffles, separates the diluted crude 300 from the water and sand.

In one preferred embodiment, the hydrogen donor "solvent" is a highly hydrogenated naphthene fraction having a boiling range usually between 150° and 250° F. For this specific example of a formation crude at about 13° API, the amount of "solvent" needed for crude extraction is approximately 25% by weight of the recovered crude.

The fluegase 122 is fed to the outer casing 50 of the production well and thence into the gas injection bores 13 to react with the hydrogen donor "solvent" and the in situ crude. Hot water at about 200° F. may also supplied into the outer casing 50 from the desalter.

Figure 10:
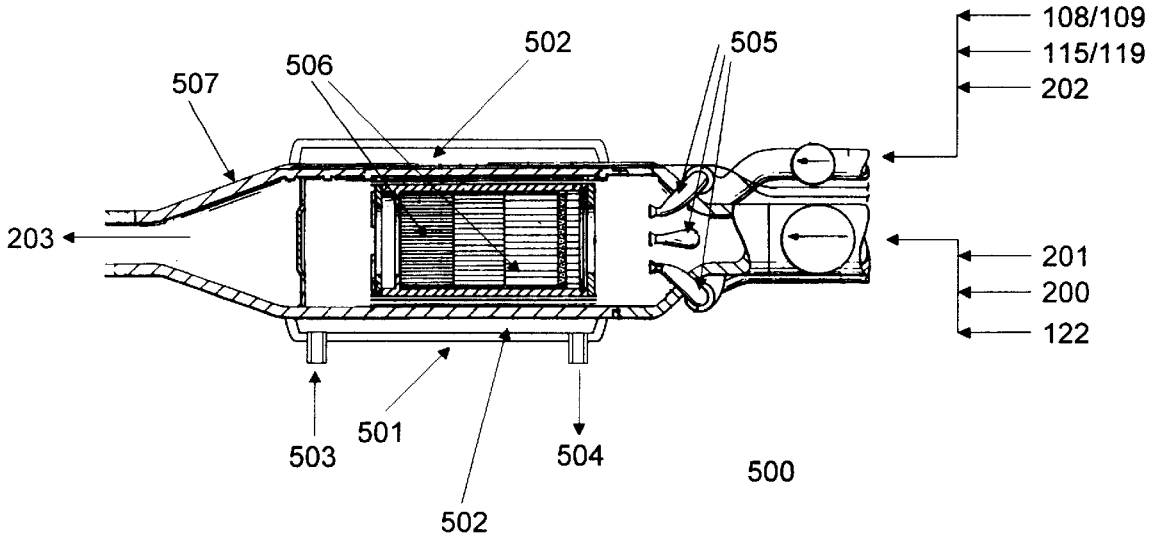
FIG. 10 is one embodiment of a catalytic combustor.

In one catalytic combustor embodiment 500, FIG. 10 shows a cutaway side view of the combustor X200. Fuel streams 108/109, 115/119 and 202 are fed at high pressure to nozzles 505. Diluents 201 and 122 are mixed with oxidant stream 200 and fed to a a mixing chamber upstream of combustion catalyst beds 506. Shell 506 may optionally be surrounded with a gas preheat jacket 501 providing a shell and annular space 502, whereby gas, such as oxident 200, may be fed in as stream 502, heated and recovered as stream 504. The product combustion flue gas 203 results from a fuel, diluent and oxidant mixture passing through the oxidizing catalyst bed causing oxidation of the fuel. Oxidation promoting catalysts are well known in the process industries such as for example beds containing metals as platinum, palladium, vanadium, iron, titanium, tungsten, copper, chromium, cobalt, aluminum, nickel, manganese, cerium, silicon, silver, molybdenum, tin, tungsten, etc. or combinations of these materials, alone or supported on various porous materials. The oxidizing catalyst is generally not required after the porous bed becomes heated as the heat alone is sufficient to catalyze the oxidation of the fuel. Thus the porous bed would not necessarily contain the oxidation catalyst for example if the combustion were initiated by an electric heater or by chemical means. However the catalyst may only be placed in the region of the porous matrix where the fuel-air mixture first contacts the bed. Thus the catalyst need not be throughout the porous bed; sand, aluminum, glass beads or other inert material may be the bulk of the porous matrix, for example.

In the alternative to a catalytic combustor, an open flame under high pressure may be used to obtain fluegas 203 so that a high intensity condensed flame is obtained and a very high combustion gas temperature is reached, not less than 3000° F.

As regards the 'daisy' well itself in FIG. 9, the slant bores 13 are fitted with internal tubes, of smaller diameter than the bore casings, to convey the hot flue gases from the thermochemical reformer to discharge filters at the bottom ends of the slant wells. Seals at the lower ends of the tubes prevent passage of the gases up the bores outside the tubes. The slant wells can, if desired, be drilled from the surface at points close around the main shaft, but in the example shown they are drilled from inside the main shaft. To this end, the main shaft 12 has a larger diameter upper section and a smaller diameter lower section, the bottom end portion of the larger diameter upper section being constituted as a drilling gas-distributing and product collecting chamber, and the slant wells commence from a platform across the chamber.

Above the chamber, the upper section of the main shaft includes, concentrically arranged and in increasing order of diameter, the central injection pipe 49 for hydrogen donor solvent, the intermediate casing 14 for product upflow, the outer casing 50 for the hot flue gases, and finally the outer bore of the shaft. The lower end of the casing 50 terminates at the roof of the chamber 63 so that the hot flue gases are discharged into the portion of the chamber above the platform thereby to enter the tubes. At the upper ends of the slant wells 13, the casings are sealed to the platform and also the gaps between the casings and the tubes are sealed by means of sealing cones, but the upper ends of the tubes are open for entry of the hot flue gases. Above the chamber, the annular space within the main shaft bore and the casing 50 is filled with thermally-insulating concrete. This concrete can be placed by means of a tube lowered initially to the deepest part of the void annular space to be filled and gradually retracted upwards as concrete is injected, keeping the lower end of the tube always beneath the level of the liquid concrete. One or more sliding thermal expansion joins may be provided in the metal casings of the main shaft.

Below the platform in the chamber, the lower section of the main shaft includes, concentrically arranged and in increasing order of diameter, the central solvent injection pipe, the intermediate casing for product upflow, and a outer casing with a multiplicity of openings fitted with filters for admitting liquid hydrocarbon product into the annular space between the casings.

When using resid 119 as a fuel, the fluegas will usually be highly contaminated with sulphur, possibly as much as 5–7% by weight. The flue gases injected into the formation will therefore contain, as major contaminants, $SO_2$, $NO_x$ and CO, and the formation rock or sand will act as a decontaminating system to strip these from the flue gases. The remaining components, primarily $CO_2$ and $N_2$ act as agents in promoting the mobility of the hydrocarbons in the formation already liquefied by the injected solvent. Any water in the formation will be converted in situ into steam by the high temperature flue gases and will augment their action. If desired, further steam can be produced by pumping or injecting waste water from the thermochemical reforming plant into the main shaft casing where it will be gasified by the high temperature flue gases on their way down the shaft.

If desired, a cyclical, instead of continuous, mode of operation can be employed. Thus, in one phase the solvent can be injected not only at the bottom of the main shaft but also at the bottoms of the slant wells and into the casing of the main shaft, so that it emerges into the formation through the intake filters as well, after which in a second phase flue gases, and steam generated in the main casing, can be injected to sweep the liquefied hydrocarbons toward and into the lift pump casing and generate the gas lift.

The whole process of extraction of the heavy hydrocarbons, with partial reforming, followed by production of a pipe-line quality product adjacent the well head in the reforming process, is entirely selfcontained and has an advantageous heat balance, losses of both heat and solvent being confined to a minimum. The energy consumption for producing a valuable saleable product from previously irrecoverable heavy hydrocarbons is therefore comparatively low, with no requirement for transport of fuel or other consumable materials to the site. Furthermore, although the locally-produced fuel used is heavily contaminated with sulphur, cleaning of the flue gases is largely inherently achieved within the process itself before any residual gases are discharged to atmosphere, which is a major factor in pollution control.

It is well known in the art of oil refining that crude oil is represented as a group of petroleum liquids separable according to their boiling ranges, wherein a boiling range liquid comprises many hydrocarbon species. With respect to the above invention, the cracking/reforming process will produce results within the objects of the invention using as crude 100 a petroleum liquid or liquids, whereby a substantial portion of crude 100 comprises a petroleum liquid having a density of 15° API or less. It is believed that a crude 100 comprising as little as 10% by volume of a petroleum liquid having a density of 15° API or less may achieve some substantial cracking/reforming of the above invention.

In addition, in the art of fired or combustion heat transfer, it is known that a small portion of the heat transfer in high temperature convection sections is radiant if substantial voids are present between convective heat transfer surfaces. This radiant heat transfer in high temperature convective heating means is not significant to the objects of the present invention, although it is known to occur. It is preferred that the high temperature heat transfer of exchanger E100 be designed to minimize such voids although, the objects of the present invention will still be obtained even in the presence of such voids.

Figure 11:
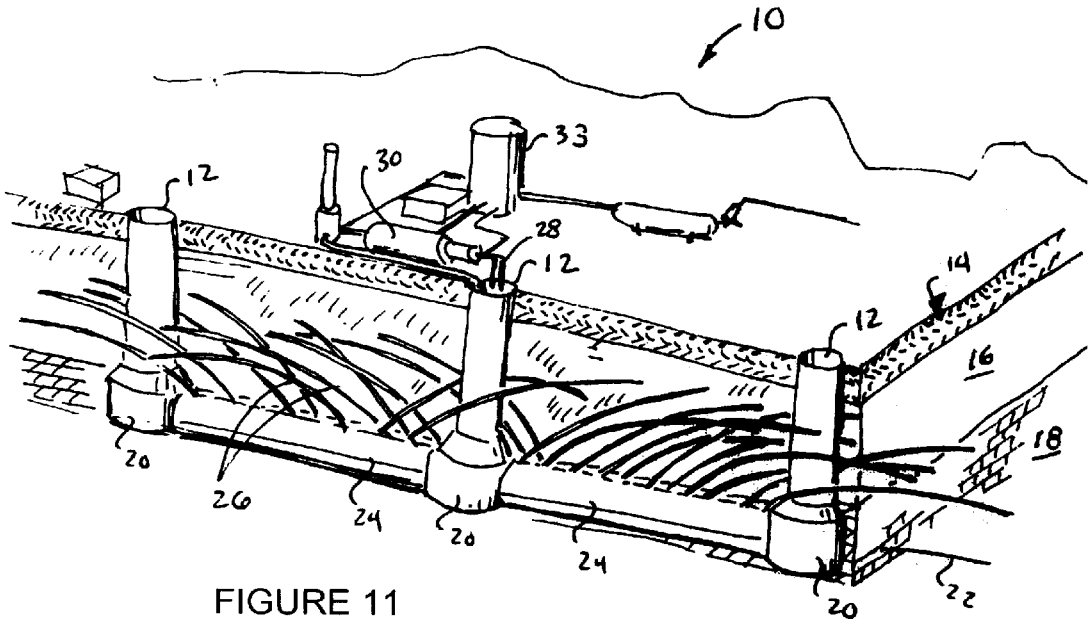
FIG. 11 is a perspective cut-away view of an oil mining operation according to the present invention showing a horizontal access tunnel and upwardly curved wells bored therefrom and a surface combustor/pre-refiner for producing heated combustion gasses and solvent.

Referring now to FIG. 11, an oil mining operation 10 per the present invention may employ three vertical mining shafts 12 extending into the surface 14 through an oil formation 16 and into a lower impermeable layer 18. The oil formation 16 may, for example, be a low permeability Annona chalk and the impermeable layer 18 may be Ozan shale. The oil formation 16 in general may stratified having layers of relatively high permeability separated by layers of low permeability.

The lower ends of the vertical mining shafts 12 open to galleries 20 at equal depth but displaced with respect to each other along a tunnel axis 22 to be joined by access tunnels 24.

Bored through the upper roof of the access tunnel 24 are a plurality of curved wells 26 each penetrating through the impermeable layer 18 and passing into different strata of the oil formation 16. The wells 26 initially extend upward from the access tunnel 24 and then approach a horizontal trajectory at their furthest extent. Referring also to FIG. 13, the placement and curvature of the wells 26 is selected so as to distribute the wells 26 evenly, to the extent practical, throughout the oil formation 16.

The center vertical mining shaft 12 provides pipelines 28 for removing the oil extracted from the oil formation 16 to the surface and for providing flue gases and hot solvents to the wells 26 as will be described. A combustor 30, a pre-refiner 33 and other support equipment, as will also be described, are located at the surface 14 near the centermost vertical mining shaft 12.

Figure 12:
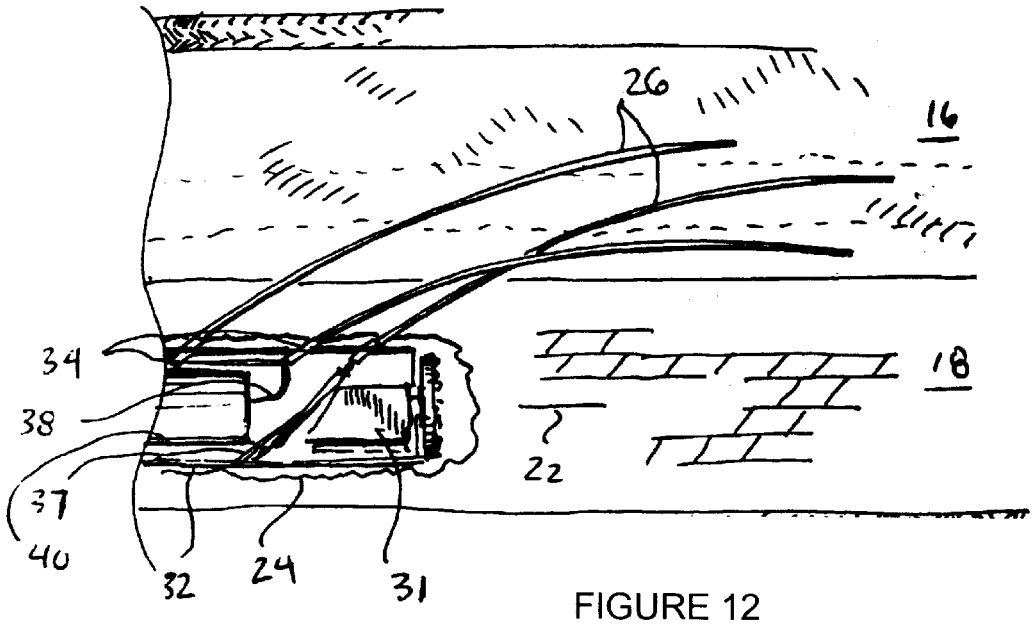
FIG. 12 is an elevational view of the access tunnel of FIG. 11 taken in cross-section along a plane aligned with the tunnel axis during construction of the tunnel showing pre-affixed drill guides attached to an outer shell of the tunnel and the cutting of oil extraction wells ahead of the tunnel for pressure relief.

Referring now to FIG. 12, the access tunnel 24 may be cut through the impermeable layer 18 from one gallery 20 by conventional mining equipment 31. As the access tunnel 24 advances, a rubberized steel outer tunnel sleeve 32 is put into place to support the tunnel walls. This outer tunnel sleeve 32 incorporates pre-affixed drill guides 34.

Drilling equipment 37 placed within the access tunnel 24 may be used to drill wells 26 extending forward along the axis 22 of the access tunnel 24 as the access tunnel 24 is cut. These wells 26 may be attached to manifold 38 allowing the flow of pressurized oil from the regions of the wells 26 reducing pressure in the oil formation 16 in advance of the access tunnel 24 thus simplifying the tunneling process. The manifold 38 in turn connects to pipelines 28 passing out of the centermost vertical mining shaft 12.

A rubberized steel inner tunnel sleeve 40 is put in place following the mining equipment 31 to provide additional rigidity to the structure of the access tunnel 24 and to shield workers from the products carried in the manifold 38 and other materials infusing through the walls of the access tunnel 24.

Referring also to FIG. 14, the access tunnel 24 has a generally arched upper cross-sectional portion and a flattened bottom portion to which the outer tunnel sleeve 32 conforms. A first and second drainage trough 42 may be formed in the outer tunnel sleeve 32 to collect liquids, including condensation, for removal by pumps (not shown). The inner tunnel sleeve 40 may, in contrast, have a generally elliptical cross-section with its longest axis oriented vertically to provide easy passage for personnel through the access tunnel 24.

The outer tunnel sleeve 32 is attached to the inner tunnel sleeve 40 at top and bottom by gussets 44 and the inner and outer tunnel sleeves 32 and 40 may be anchored to the impermeable layer 18 by anchor bolts 46. The combination of bracing of the inner and outer tunnel sleeves 32 and 40 against each other and their anchoring to the impermeable layer 18 provides an extremely rigid tunnel liner.

Referring now to FIG. 17, each panel 50 may be generally rectangular in outline with inwardly extending flanges 52 having bolt holes 54 so that the panels may attach to adjacent similarly constructed panels. Access ports 56 may be cut through the walls of the panels 50 for access to the wells 26 and the associated connection pipes and gauges. Such access ports 56 may have replaceable covers to seal them when they are not in use. Reinforced windows 58 may also be placed at strategic locations for observation of process instrumentation and the like.

Referring again to FIG. 14, the space between the outer tunnel sleeve 32 and the impermeable layer 18 may be filled with a grouting material 60 that provides a barrier against the infusion of gases through the impermeable layer 18. In a preferred embodiment, this grout is constructed of a sulfur based polymer.

The wells 26 cut from the roof of the access tunnel 24 open within the space between the inner tunnel sleeve 40 and outer tunnel sleeve 32 and may be connected through means of a multi-part casing and hoses (to be described) to the manifold 38 which conduct oil from the wells 26 along the access tunnel 24. Manifolds 38 also conduct hot flue gases and solvents to the wells 26, as will be described further below. For this reason, manifold 38 is surrounded by a gas permeable heat resistant thermal insulation 48.

Referring now to FIG. 15, once cut, each well 26 has a multi-part well casing 62 inserted into it. The multi-part well casing 62 consists of three concentric pipes. The first pipe 64 has an outer diameter substantially equal to the inner diameter of the well 26 and extend the short way into the well 26 ending substantially at the beginning of the oil formation 16. This pipe 64 is connected by means of an outlet pipe 66 to an armored hose 68 connecting in turn to a pipe 70 being part of the manifold 38.

Centered within pipe 64 is a smaller diameter pipe 72 extending upward to a packer 74. Packer 74 is an elastic material having a generally cylindrical form whose outer diameter approximately matches the inner diameter of the well 26. A first zone 76 of communication with the unsheathed wall of the well 26 is provided between the end of pipe 64 and the beginning of packer 74. This zone 76 communicates with pipe 70.

Referring now also to FIG. 16, pipe 72 terminates at a flange 78 abutting a near end of the packer 74. An inlet pipe 80 passes through the wall of pipe 72 and conducts material from pipe 72 to pipe 84 of manifold 38 via an armored hose 82.

Referring also to FIG. 16, centered within pipe 72 is pipe 86 having yet a smaller diameter than pipe 72. Pipe 86 connects via armored hose 83 to pipe 85 of manifold 38. The end of pipe 86 removed from the access tunnel 24 passes through flange 78 and fits within a centrally located bore 90 in the packer 74. The bore 90 is approximately equal in inner diameter to pipe 72.

Pipe 86 passes through the packer 74 and into a perforated pipe 92 of similar diameter to pipe 72. The perforated pipe 92 has a series of holes in its outer surface to provide passage of fluid material into or out of the space between perforated pipe 92 and pipe 86.

Perforated pipe 92 is attached at each end to flanges 94 having a diameter approximately equal to that of the packer 74 and thus of the well 26. One flange 94 fits against the face of the packer 74, opposite that face abutted by flange 78. The remaining flange 94 fits against a face of a second packer 96 substantially the same as the first packer 74, however, with a smaller bore 98 generally equal in size to the outer diameter of pipe 86.

Pipe 86 thus passes loosely through the bore 90 of packer 74 through the perforated pipe 92, then through packer 96 and at its far end terminates in a flange 100.

The length of perforated pipe 92 defines a second zone 102 communicating with the unsheathed well 26 positioned further along the well 26 than zone 76 previously described and shown in FIG. 15. Materials from pipe 84 are conducted to this zone 104.

A final zone 104 is defined by the area of the well 26 beyond the flange 100.

It will be understood that each of these zones 76, 102 and 104 may be separately used to introduce solvents or hot gases to portions of the well 26 or to extract oil from other portions of the well 26. Prevention of the flow of materials directly between zones without passing into the oil formation 16 is prevented by the packers 96 and 74 which may be expanded against the inner wall of the well 26 by an inserting motion of pipe 72 into the well 26 and an extractive motion of pipe 86 out of the well as indicated by arrows 106. This, relative motion of pipes 72 and 86 causes the packers 74 and 96 to be compressed between flanges 78, 94 and 100 causing them to expand and seal against the inner walls of the well 26.

Referring to FIG. 15, the zone 104 may be fractured by the introduction of a fast burning propellant. The propellant produces a rapidly expanding gas which fragments or rubblizes the oil formation 16 in the zone 104. During this rubbilization process, the casing 62 may be removed and a blocking structure may be inserted at the location of flange 100 to contain the force of the expanding gas to the zone 104.

Figure 19:
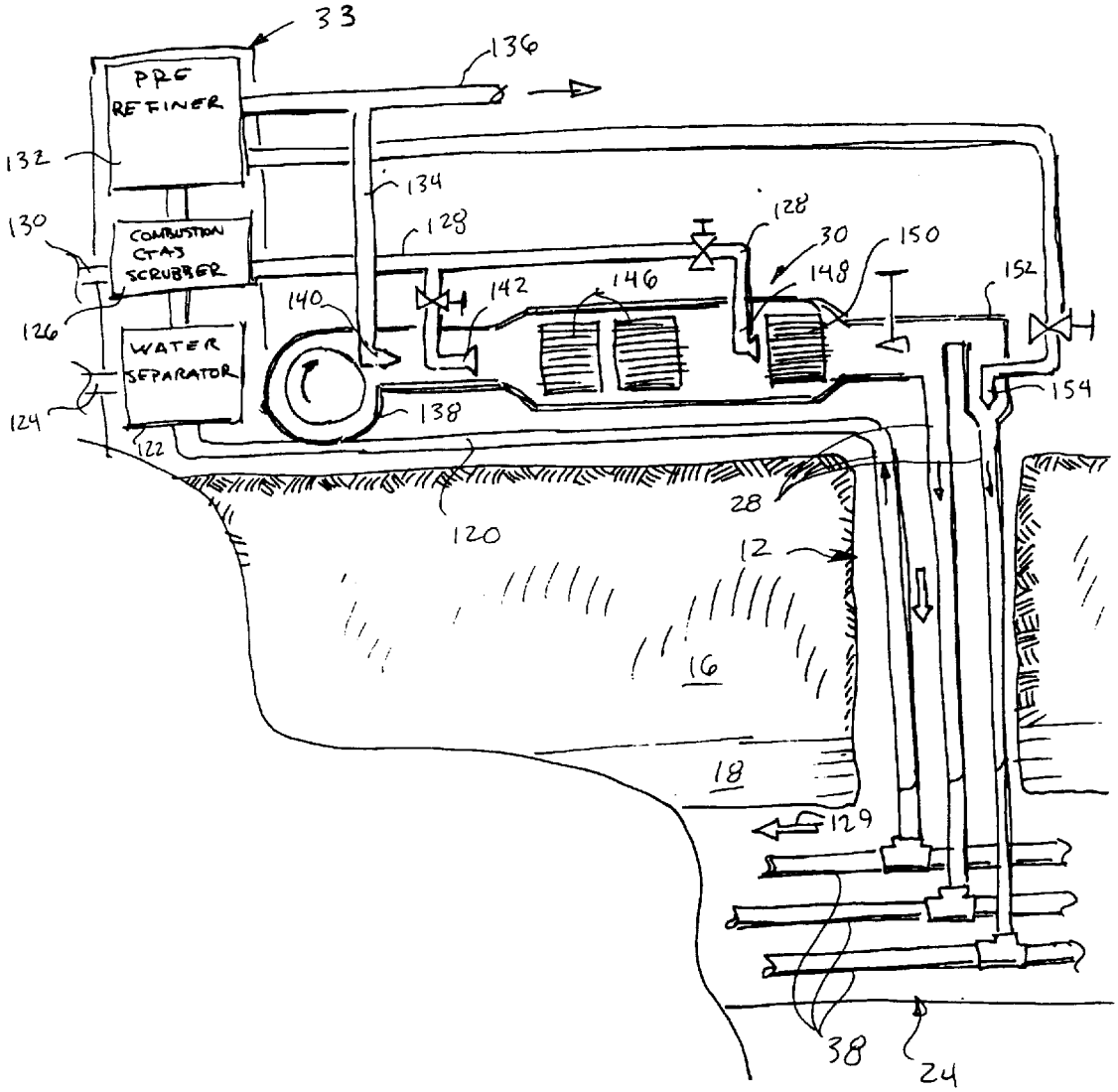
FIG. 19 is a schematic diagram of the combustor/pre-refiner at the surface of the mining operation as shown in FIG. 11 providing soot-less combustion gases and heated solvents to the manifolds of FIGS. 14 and 14.

Referring now to FIG. 19, each of the zones 76, 102 and 104 may be separately provided with high temperature soot-less flue gases comprising primarily $CO_2$ and $N_2$ or nitrogen or a combination of flue gases and vaporized hydrocarbon solvent. The solvent may be formed from the oil of the oil formation 16 as is extracted in initial quantities under the pressure of the formation.

Figure 18:
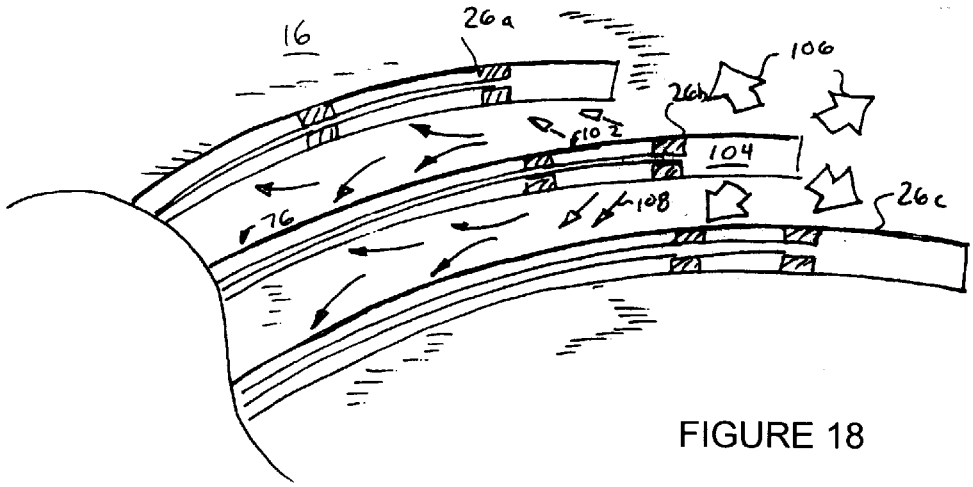
FIG. 18 is a schematic representation of the three wells of FIG. 11 in elevational cross-section showing the introduction of barrier gasses, hot solvents, and the extraction oil through separate channels of the multi-part casings.

Referring to FIG. 18, three proximate wells 26*a*, 26*b* and 26*c* may be placed within the oil formation 16. The center well 26*b* may have hot gases introduced into its zone 104 which expand into the oil formation 16 as indicated by arrows 106 to form a barrier against oil migration within the oil formation 16. Simultaneously, solvent indicated by arrows 108 may be introduced into zone 102 in nearby well 26*b*. The barrier formed by the hot gases flowing as indicated by arrow 106 causes the solvents indicated by arrows 108 to flow inward collecting oil from the oil formation 16 and drawing it into zone 76 of the well 26*b* or into other collecting regions of wells 26*a* and 26*c*.

Throughout the period of the production of oil, the different wells 26*a*, 26*b* and 26*c* may each provide barriering or solvent introduction or may each provide removal of collected oil. For each well, the zones 76,102 or 104 having hot gas or solvent or receiving oil may be rotated according to a schedule determined by a monitoring of the production of each well and a modeling of oil flow within the oil formation 16.

Referring again to FIG. 19, generally the hot gas and solvents used in the above-described process may be generated on site by means of combustor 30.

The combustor 30 receives oil from the oil formation 16 via manifold 38 to pipelines 28 up vertical mining shaft 12. The hot flue gas, oil and solvent mixture passing upward in pipelines 28 through the vertical mining shaft 12 is cooled by the downward flowing air indicated by arrow 129 which serves as a counter current heat exchanger to cool the combustion gases as will later be used to moderate the combustion process itself.

A water separator 122 removes any water from the extracted oil received through pipe 120 and also removes mixed solvent and flue gas.

Removed water is transported by pipe 124 to a separate collection and processing unit. The flue gas, oil and solvent are then passed to a combustion gas scrubber 126 which collects a portion of the combustion gases (principally $CO_2$ and $N_2$) for use in moderating the combustion temperature of the combustor 30 as will be described. These gases are transported along pipe 128.

The remaining flue gas follows pipe 130 and is scrubbed for release into the atmosphere.

The oil and solvent then pass to the pre-refiner 33 which may perform an initial fractional separation of these materials to produce a fuel portion passed along pipe 134 to the combustor 30 and preprocessed crude pumped along pipe 136 to a subsequent collection or piping facility.

The combustor 30, receiving the fuel portion and the cooled combustion gasses, includes a high pressure air pump 138 forcing air past an orifice 140 through which a fuel portion of the extracted oil is metered and premixed with cooled combustion gasses from pipe 134 introduced through nozzle 142. The mixed combustion gases and fuel pass over catalyst beds 146 which catalytically combine the fuel with oxygen from the air to produce a controllable low temperature combustion of the fuel. Catalysts and combustors of this type are described in U.S. Pat. No. 4,243,098 issued Jan. 6, 1981, 4,687,491 issued Aug. 18, 1987, and 4,930,454 issued Jun. 5, 1990, hereby incorporated by reference.

Downstream from the catalyst beds 146, additional cooled combustion gases are introduced through nozzle 148 to control the temperature of the combustion products, a role previously filled by water injection.

A final soot combustion catalyst 150 follows nozzle 148 to produce an extremely low soot content combustion gas mixture under high pressure.

A portion of this "soot-less" combustion gas is diverted to a mixer 152 which introduces a solvent portion of the extracted oil obtained from the pre-refiner 32 through orifice 154. Generally the solvent will be a mixture of hydrocarbons of different weights from 58 to about 300.

These volatilized solvents and hot combustion gases from mixer 152 are conducted to the pipelines 28 to manifold 38 for use in the wells as has been described.

A second portion of the hot combustion gas unmixed with solvent is piped directly down a separate pipeline 28 and provided to manifold 38 for use of the barriering operations as has been described.

The above design disclosures present the skilled person with considerable and wide ranges from which to choose appropriate obvious modifications for the above examples. However, the objects of the present invention will still be obtained by the skilled person applying such design disclosures in an appropriate manner.

TABLE 1

HEAVY CRUDE FOR PROCESSING

| San Ardo Crude oil | Vol % BPD | BPD | ° API | Sp.Gr. @ 15.50 C | kg/Bbl | kg/hr |
|---|---|---|---|---|---|---|
| from wells | 100 | 500 | 13.7 | 0.9745 | 155 | 3,230 |

TABLE 2

STRAIGHT RUN OF RAW CRUDE @ 2.0 bars

| | Vol % BPD | BPD | ° API | Sp.Gr. @ 15.50 C | kg/Bbl | kg/hr |
|---|---|---|---|---|---|---|
| Naphtha | 2.4 | 12 | 45 | 0.8017 | 128 | 64 |
| KERO | 11.8 | 59 | 32 | 0.8654 | 138 | 339 |
| Lt. G.O. | 7.8 | 39 | 25 | 0.9042 | 143 | 234 |
| G.O | 10 | 50 | 20 | 0.934 | 149 | 309 |
| Residue (reform.) | 68 | 340 | 8.1 | 1.0134 | 161 | 2,284 |
| Total | 100 | 500 | | | | 3,230 |

TABLE 3

| STRAIGHT RUN OF SOLVENT FRACTION | Vol % BPD | BPD | ° API | Sp.Gr. @ 15.50 C | kg/Bbl | kg/hr |
|---|---|---|---|---|---|---|
| Naphtha + Kero (Product for recycling) | 14.2 | 71 | 34.1 | 0.8546 | 136 | 403 |

TABLE 4

| STRAIGHT RUN OF GAS OIL | Vol % BPD | BPD | ° API | Sp.Gr. @ 15.50 C | kg/Bbl | kg/hr |
|---|---|---|---|---|---|---|
| Lt. G.O. + G.O. (Final product) | 17.8 | 89 | 22.2 | 0.9209 | 146 | 543 |
| Total out of reforming | 32 | 160 | | | | 946 |

TABLE 5

| THERMALCRACKING @ 540° C. | Wt % | kg/hr | kg/bbl | kg/day | BPD |
|---|---|---|---|---|---|
| First Pass 2,284 kg/hr (Fresh Feed) | | | | | |
| H.C. GAS | 15 | 343 | | | |
| Solvent | 14 | 320 | 138 | 7,680 | 55.6 |
| Gas Oil | 36 | 822 | 149 | 19,728 | 132.4 |
| Residue for reform. | 30 | 685 | | | |
| Carbon | 5 | 114 | | | |
| Total | 100 | 2,284 | | | |
| Second Pass 685 kg/hr | | | | | |
| H.C. Gas | 18 | 123 | | | |
| Solvent | 11 | 76 | 138 | 181 | 13.2 |
| Gas Oil | 31 | 212 | 148 | 5,100 | 34.4 |
| Residue for reform. | 30 | 205 | | | |
| Carbon | 10 | 69 | | | |
| Total | 100 | 685 | | | |
| Third Pass 205 kg/hr | | | | | |
| H.C. Gas | 25 | 51 | | | |
| Solvent | 5 | 10 | 138 | 240 | 1.7 |
| Gas Oil | 24 | 50 | 149 | 1,200 | 8 |
| Residue for fuel | 30 | 61 | 168 | 1,464 | 8.7 |
| Carbon | 16 | 33 | | | |
| Total | 100 | 205 | | | 18.4 |

TABLE 6

| PRODUCTS @ 540° C. CRACKING | kg/hr | Sp. Gr. | °API | BPD | Av. °API | Wt/barrel |
|---|---|---|---|---|---|---|
| NAPHTHA | 64 | 0.8017 | 45 | 11.97 | | 9.596 |
| NAPHTHA | 69 | 0.7547 | 56 | 13.71 | 50.7°API | 10.349 |
| KERO | 339 | 0.8654 | 32 | 59.03 | | 51.085 |
| KERO | 337 | 0.8348 | 38 | 60.95 | 35.0°API | 50.88 |
| G.O | 309 | 0.934 | 20 | 50 | | 46.76 |
| G.O. | 1,084 | 0.9159 | 23 | 178.48 | | 163.47 |
| G.O. | 234 | 0.9042 | 25 | 38.98 | 22.7°API | 35.246 |
| RESIDUE | 62 | 1.0253 | 6.5 | 9.1 | 6.5°API | 9.326 |
| Total | 2,498 | | | | | 422.22 |

TABLE 6-continued

| PRODUCTS @ 540° C. CRACKING | kg/hr | Sp. Gr. | °API | BPD | Av. °API | Wt/barrel |
|---|---|---|---|---|---|---|
| Final Products Mix | | | | | 27.1°API | 376.652 |

TABLE 7

| THERMALCRACKING @ 482° C. | Wt % | kg/hr | kg/bbl | kg/day | BPD |
|---|---|---|---|---|---|
| First Pass 2,284 kg/hr (Fresh Feed) | | | | | |
| H.C. GAS | 8 | 183 | | | |
| Solvent | 10 | 229 | 138 | 5,496 | 39.8 |
| Gas Oil | 29 | 662 | 149 | 15,888 | 106.6 |
| Residue for reform. | 50 | 1,142 | | | |
| Carbon | 3 | 69 | | | |
| Total | 100 | 2,284 | | | 146.4 |
| Second Pass 1,142 kg/hr | | | | | |
| H.C. Gas | 10 | 114 | | | |
| Solvent | 7 | 80 | 138 | 1,920 | 13.9 |
| Gas Oil | 25 | 285 | 148 | 6,840 | 46.2 |
| Residue for reform. | 52 | 594 | | | |
| Carbon | 6 | 69 | | | |
| Total | 100 | 1,141 | | | 60.1 |
| Third Pass 594 kg/hr | | | | | |
| H.C. Gas | 16 | 95 | | | |
| Solvent | 3 | 18 | 138 | 432 | 3.1 |
| Gas Oil | 19 | 113 | 149 | 2,712 | 18.2 |
| Residue for fuel | 52 | 309 | 168 | 7,416 | 44.1 |
| Carbon | 10 | 60 | | | |
| Total | 100 | 595 | | | 65.4 |

TABLE 8

| PRODUCTS @ 482° C. CRACKING | kg/hr | Sp. Gr. | °API | BPD | Av. °API | Wt/barrel |
|---|---|---|---|---|---|---|
| NAPHTHA | 64 | 0.8017 | 45 | 11.97 | | 9.596 |
| NAPHTHA | 55 | 0.7547 | 56 | 10.99 | 50.1°API | 8.297 |
| KERO | 339 | 0.8654 | 32 | 59.03 | | 51.085 |
| KERO | 271 | 0.8348 | 38 | 49.04 | 34.7°API | 40.937 |
| G.O | 309 | 0.934 | 20 | 50 | | 46.7 |
| G.O. | 1,060 | 0.9159 | 23 | 174.57 | | 159.977 |
| G.O. | 234 | 0.9042 | 25 | 38.98 | 22.7°API | 35.246 |
| RESIDUE | 309 | 1.0328 | 5.5 | 45.15 | 5.5°API | 46.629 |
| Total | 2,641 | | | | | 439.83 |
| Final Products Mix | | | | | 24.7°API | 398.467 |

TABLE 9

| CRUDE UPGRADING PROCESS. RESULTING CHEMICAL DATA | | | | | | |
|---|---|---|---|---|---|---|
| TABLE A H.C. GAS COMPOSITION | | | TABLE B SOLVENT COMPOSITION | | TABLE C FLUE GAS COMPOSITION | |
| COMP. | V % | wt % | COMP. | wt % | COMP. | wt % |
| H2 | 10 | 0.8 | C4 | 0.5 | CO2 | 14.3 |
| C1 | 40 | 24.9 | C5 | 0.6 | H2O | 27.3 |

TABLE 9-continued

CRUDE UPGRADING PROCESS. RESULTING CHEMICAL DATA

| TABLE A H.C. GAS COMPOSITION | | | TABLE B SOLVENT COMPOSITION | | TABLE C FLUE GAS COMPOSITION | |
|---|---|---|---|---|---|---|
| COMP. | V % | wt % | COMP. | wt % | COMP. | wt % |
| C2 | 5 | 5.8 | C6 | 1.4 | O2 | 1.7 |
| C = 2 | 25 | 27.2 | C7 | 1.5 | N2 | 56.7 |
| C3 | 2 | 3.4 | C8 | 2.8 | | |
| C = 3 | 8 | 13.1 | C9 | 6.9 | | |
| C4'5 | 2 | 4.5 | C10 | 9.2 | | |
| C = 4'5 | 4 | 8.2 | C11 | 10.5 | | |
| C5'5 | 3 | 8.3 | C12 | 12 | | |
| C6'5 | 1 | 3.3 | C13 | 14.6 | | |
| | | | C14 | 16 | | |
| | | | C15 | 17 | | |
| | | | C16 | 7 | | |

I claim:

1. A process for a first liquid petroleum fraction for reducing the specific gravity thereof comprising:

(a) a first liquid petroleum stream comprising the first liquid petroleum fraction, wherein the first liquid petroleum fraction is a substantial portion of the first liquid petroleum stream and has a density equal to or less than about 15° API;

(b) introducing the first liquid petroleum stream into convective heating means for heating the first liquid petroleum stream substantially only by convective heat transfer from a hot gas and out of the presence of a catalyst to less than an average liquid temperature of about 1000° F.; and (c) obtaining a substantially thermally cracked stream from the heating means.

2. The process of claim 1 wherein the heating means comprise conduits for the first liquid petroleum stream with means for enhancing flow turbulence of the first liquid petroleum stream against internal walls of the conduits.

3. The process of claim 2 wherein the heating means further comprise extended surface on an external surface of the conduits.

4. The process of claim 3 wherein the heating means are heated solely with a heating gas at a temperature of less than about 2000° F.

5. The process of claim 4 wherein the heating gas consists of a fluegas from catalytic or open flame combustion of fuel in a combustor and is cooled by heat exchange with a high temperature heat sink.

6. The process of claim 5 wherein the fuel comprises second liquid petroleum stream having a density equal to or less than about 15° API.

7. The process of claim 6 wherein a quenched stream is formed by the thermally cracked stream mixing intimately with a third liquid petroleum stream comprising the second liquid petroleum fraction.

8. The process of claim 7 wherein the fluegas exiting the heating means indirectly heats the quenched stream.

9. The process of claim 8 wherein a solvent portion is separated from the quenched stream, mixed with the fluegas after it heats the quenched stream, and the cooled fluegas and solvent portion mixture is then injected into a formation for recovery of heavy crude.

10. A process for a first liquid petroleum fraction for reducing the specific gravity thereof comprising:

(a) a first liquid petroleum stream comprising the first liquid petroleum fraction, wherein the first liquid petroleum fraction is a substantial portion of the first liquid petroleum stream and has a density equal to or less than about 15° API;

(b) introducing the first liquid petroleum stream into heating means for heating the first liquid petroleum stream in conduits and out of the presence of a catalyst for a period of less than about 25 seconds to less than an average liquid temperature of about 1000° F.;

(c) stopping the flow of the first petroleum stream to the heating means and flowing steam at high velocity through the conduits for a period of less than about 25 seconds;

(c) repeating steps (b) and (c) to obtain a thermally cracked stream and a reformed stream, respectively, from the heating means.

11. The process of claim 10 wherein the conduits comprise means for enhancing flow turbulence of the first liquid petroleum stream against internal walls of the conduits.

12. The process of claim 11 wherein the heating means further comprise extended surface on an external surface of the conduits.

13. The process of claim 12 wherein the heating means are heated solely with a heating gas at a temperature of less than about 2000° F.

14. The process of claim 13 wherein the heating gas consists of a fluegas from catalytic or open flame combustion of fuel in a combustor and is cooled by heat exchange with a high temperature heat sink.

15. The process of claim 14 wherein the fuel comprises second liquid petroleum stream having a density equal to or less than about 15° API.

16. The process of claim 15 wherein a quenched stream is formed by the thermally cracked stream mixing intimately with a third liquid petroleum stream comprising the second liquid petroleum fraction.

17. The process of claim 16 wherein the fluegas exiting the heating means indirectly heats the quenched stream.

18. The process of claim 17 wherein a solvent portion is separated from the quenched stream, mixed with the fluegas after it heats the quenched stream, and the cooled fluegas and solvent portion mixture is then injected into a formation for recovery of heavy crude.

* * * * *